US012215914B2

(12) United States Patent
Yoon

(10) Patent No.: US 12,215,914 B2
(45) Date of Patent: Feb. 4, 2025

(54) REFRIGERATOR

(71) Applicant: LG Electronics Inc., Seoul (KR)

(72) Inventor: Han Byeol Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 17/348,381

(22) Filed: Jun. 15, 2021

(65) Prior Publication Data

US 2022/0011038 A1 Jan. 13, 2022

(30) Foreign Application Priority Data

Jul. 10, 2020 (KR) ..... 10-2020-0085332

(51) Int. Cl.
*F25D 17/08* (2006.01)
*F25D 17/06* (2006.01)

(52) U.S. Cl.
CPC ..... *F25D 17/08* (2013.01); *F25D 17/067* (2013.01); *F25D 2317/0671* (2013.01); *F25D 2323/0024* (2013.01)

(58) Field of Classification Search
CPC ..... F25D 17/08; F25D 17/067; F25D 2317/0671; F25D 2323/0024; F25D 2317/067; F25D 2317/0683; F25D 17/045; F25D 17/062; F25D 21/04; F25D 21/14; F25D 2317/041; F25D 2317/063; F25D 23/028; F25D 2317/0672; F25D 2600/04; F25D 23/003; F25D 23/087; F25D 23/10; F25D 17/06; F25D 2317/068;

(Continued)

(56) References Cited

U.S. PATENT DOCUMENTS

2008/0202149 A1 8/2008 Lim
2008/0256971 A1* 10/2008 Bae et al. ..... F25D 17/062 62/285

(Continued)

FOREIGN PATENT DOCUMENTS

CN 106524653 3/2017
CN 106958973 7/2017

(Continued)

OTHER PUBLICATIONS

WO-2018108055-A1 Translation (Year: 2018).*

(Continued)

*Primary Examiner* — Elizabeth J Martin
*Assistant Examiner* — Dario Antonio Deleon
(74) *Attorney, Agent, or Firm* — Fish & Richardson P.C.

(57) ABSTRACT

A refrigerator includes a first discharge part such that a temperature distribution difference between the upper section (upper space relative to the center portion of the inside of a storage compartment) of the inside of the storage compartment and the lower section (lower space relative to the center portion of the inside of the storage compartment) of the inside of the storage compartment may be reduced. In addition, water produced in the surrounding area of a blower fan may flow down into a flow path formed under the blower fan such that the loss of the flow amount of cold air may be reduced. Due to such a structure of the refrigerator, even temperature distribution inside of the storage compartment may be realized, and consumption efficiency may be improved.

19 Claims, 15 Drawing Sheets

(58) Field of Classification Search
CPC ..... F25D 2321/141; F25D 2500/02; F25D 15/00; F25D 21/125; F25D 23/065; F25B 2321/0251; F25B 21/02; G07F 17/12; F28F 13/06
See application file for complete search history.

(56) References Cited

U.S. PATENT DOCUMENTS

| | | | | |
|---|---|---|---|---|
| 2010/0180620 | A1* | 7/2010 | Lee et al. | F25D 17/067 62/291 |
| 2014/0157812 | A1* | 6/2014 | Hwang | F04D 27/005 62/285 |
| 2017/0343269 | A1* | 5/2017 | Kim et al. | F25D 2317/063 |
| 2018/0306484 | A1* | 10/2018 | Cha et al. | F25D 17/08 |

FOREIGN PATENT DOCUMENTS

| | | | | |
|---|---|---|---|---|
| EP | 3936797 | | 1/2022 | |
| JP | WO-2018108055 | A1 * | 6/2018 | F25D 17/045 |
| KR | 20070065575 | A * | 6/2007 | F25D 17/067 |
| KR | 3301385 | A1 * | 4/2018 | F25D 17/06 |
| KR | 20180035618 | | 4/2018 | |
| KR | 1020190010340 | | 1/2019 | |
| KR | 1020190010341 | | 1/2019 | |
| KR | 1020190019428 | | 2/2019 | |
| WO | WO2018108055 | | 6/2018 | |
| WO | WO2019001501 | | 1/2019 | |
| WO | WO 2019001501 | A1 * | 1/2019 | F25D 17/062 |

OTHER PUBLICATIONS

WO 2019001501 A1 Translation (Year: 2019).*
KR 20070065575 A Translation (Year: 2007).*
Extended European Search Report in European Appln. No. 21180701.1, dated Nov. 30, 2021, 8 pages.
Office Action in Australian Application No. 2021204088, dated May 19, 2022, 4 pages.
Office Action in Australian Application No. 2021204088, dated May 12, 2023, 7 pages.

* cited by examiner

REFRIGERATOR

CROSS REFERENCE TO RELATED APPLICATION

The present application claims priority to Korean Patent Application No. 10-2020-0085332, filed on Jul. 10, 2020, the entire contents of which are incorporated herein for all purposes by this reference.

TECHNICAL FIELD

The present disclosure relates to a refrigerator which is configured to have one storage compartment and to keep goods stored in the storage compartment at low temperature.

BACKGROUND

Generally, a refrigerator is a household appliance which stores various foods or beverages for a long time with cold air produced by circulation of refrigerant according to a refrigeration cycle.

Such a refrigerator may be divided into a refrigerator which can commonly store goods irrespective of the kinds of the goods such as food or beverages to be stored, and each dedicated refrigerator having a structure or function different from each other according to the kinds of goods to be stored.

Recently, a dedicated refrigerator which has one storage compartment and performs freezing or refrigerating operation for the storage compartment has been provided.

For example, one storage compartment may be operated (refrigeration or freezing operation) by the operation of the refrigeration cycle including a compressor, a condenser, and an evaporator.

Particularly, the dedicated refrigerator may be divided into a refrigerator for refrigerating stored goods and a refrigerator for freezing stored goods.

Accordingly, a user may use one of the refrigerator for freezing and the refrigerator for refrigeration, or may use the refrigerator for freezing and the refrigerator for refrigeration which are placed side by side, or may use a plurality of refrigerators for freezing or a plurality of refrigerators for refrigeration which are placed side by side. Accordingly, the dedicated refrigerator may be variously used according to the needs of a user.

The dedicated refrigerator described above may include the type of refrigerators disclosed in Korean Patent Application Publication No. 10-2019-0010340, Korean Patent Application Publication No. 10-2019-0010341, and Korean Patent Application Publication No. 10-2019-0019428.

The conventional normal dedicated refrigerator described above is configured such that cold air is sufficiently supplied to each storage section of a storage compartment located at the upper side of a blower fan relative thereto.

However, the cold air is not supplied or is insufficiently supplied to a storage section of the storage compartment located at the front of the blower fan, so even temperature distribution is not realized in the entirety of the refrigerator.

That is, cold air is efficiently supplied to the upper storage compartment located at the upper side of the blower fan relative thereto through a duct, whereas cold air is supplied only to the lowest space of a lower storage compartment located at the lower side of the blower fan relative thereto.

Accordingly, temperature difference between the upper storage compartment and the lower storage compartment is great, which is required to be improved.

In addition, the conventional normal dedicated refrigerator is configured such that water produced in the surrounding area of the blower fan is drained to the outside of a flow path through a drain hole formed in a shroud.

However, in the drainage structure, the drained water is supplied to the evaporator, so the risk that the water is attached to the evaporator is great.

Furthermore, portion of cold air blown by the operation of the blower fan is discharged to the outside through the drain hole, which causes the loss of the flow amount of the cold air.

SUMMARY

Accordingly, the present disclosure has been made keeping in mind the above problems occurring in the related art, and the present disclosure is intended to propose a new type of refrigerator, in which cold air may be sufficiently supplied even to a storage compartment located at the front of a blower fan such that even temperature distribution may be maintained in the entirety of the refrigerator.

In addition, the present disclosure is intended to propose a new type of refrigerator, in which a structure for discharging water produced in the surrounding area of the blower fan may allow the water to be discharged to a position located under an evaporator through the inside of a flow path such that the water is prevented from being attached to the evaporator and the loss of the flow amount of cold air is prevented.

In order to achieve the above objectives, in the refrigerator of the present disclosure, a first discharge part may be provided at a first duct assembly to which a blower fan is coupled, the first discharge part discharging cold air into the storage compartment located at the height of a position at which the blower fan is located. Accordingly, the cold air may be sufficiently supplied to a portion of the inside of the storage compartment located at the front of the blower fan, so even temperature distribution may be realized inside the storage compartment.

In addition, in the refrigerator of the present disclosure, a second discharge part discharging cold air into the storage compartment may be provided at the lower end portion of the first duct assembly. Accordingly, the cold air may be sufficiently supplied to the lower space of the inside of the storage compartment.

Furthermore, in the refrigerator of the present disclosure, the second discharge part may be provided at a center portion of the lower end of the first duct assembly. Accordingly, the cold air may be sufficiently supplied to the lower center portion of the inside of the storage compartment.

Additionally, in the refrigerator of the present disclosure, an introduction duct may be provided at each of the opposite sides of the second discharge part. Accordingly, cold air supplied into the storage compartment and cold air flowing toward an evaporator from the storage compartment may not meet each other.

In addition, in the refrigerator of the present disclosure, a filtering member may be provided in the introduction duct. Accordingly, odor components and foreign matter contained in cold air supplied to the evaporator through the introduction duct may be removed.

The filtering member may be detachably installed in the introduction duct. Accordingly, the replacement and maintenance of the filtering member may be performed.

Furthermore, in the refrigerator of the present disclosure, a third discharge part may be provided at the center portion of the first duct assembly. Accordingly, cold air may be supplied into the storage compartment located at the front of the first duct assembly.

Additionally, in the refrigerator of the present disclosure, a limiting protrusion may be formed on the first duct assembly.

Accordingly, the amount of the cold air flowing to the third discharge part may be partially limited.

In addition, in the refrigerator of the present disclosure, the limiting protrusion may be formed at the upper side of the third discharge part. Accordingly, the cold air discharged to the storage compartment through the third discharge part after flowing downward from the upper side of the third discharge part may be partially limited.

Furthermore, in the refrigerator of the present disclosure, the first discharge part may be located at a side higher than the center of the blower fan. Accordingly, cold air circulating along the circumferential direction of the blower fan may be efficiently discharged to the storage compartment through the first discharge part.

Additionally, in the refrigerator of the present disclosure, the first discharge part may be located at each of the opposite sides of the blower fan. Accordingly, cold air may be efficiently supplied to the opposite space of the inside of the storage compartment.

In addition, in the refrigerator of the present disclosure, the first duct assembly may include a first part. Accordingly, the evaporator may be blocked from the inside of the storage compartment. Furthermore, in the refrigerator of the present disclosure, the first duct assembly may include a second part. Accordingly, the first duct assembly may be coupled to and decoupled from a second duct assembly.

Additionally, in the refrigerator of the present disclosure, the second part may be configured to gradually incline rearward from the upper end of the first part. Accordingly, the inner space of the storage compartment may be sufficiently secured as much as possible and the flow resistance of cold air may be reduced.

In addition, in the refrigerator of the present disclosure, the blower fan may be provided at the upper portion of the first part. Accordingly, cold air blown by the blower fan may be sufficiently supplied to the upper end of the second duct assembly.

Furthermore, in the refrigerator of the present disclosure, the first discharge part may be located to be adjacent to a boundary portion between the first part and the second part. Accordingly, cold air may be supplied into the storage compartment at which the boundary portion between the first part and the second part is located.

Additionally, in the refrigerator of the present disclosure, the first duct assembly may include a shroud and a grille plate. Accordingly, the blower fan may be coupled thereto without a separate fan housing, and cold air blown by the operation of the blower fan may be guided to efficiently flow in a designated direction.

In addition, in the refrigerator of the present disclosure, the first discharge part may be formed at the grille plate by protruding forward therefrom.

Furthermore, in the refrigerator of the present disclosure, a flow guide may be formed in the first duct assembly. Accordingly, the flow of cold air blown by the blower fan may be guided in each direction.

Additionally, the refrigerator of the present disclosure may include a first flow guide. Accordingly, a circumferential flow path may be formed along the circumference of the blower fan.

In addition, the refrigerator of the present disclosure may include a second flow guide. Accordingly, an upper flow path allowing cold air to be delivered to the second duct assembly from the circumferential flow path may be formed.

Furthermore, the refrigerator of the present disclosure may include a third flow guide. Accordingly, a lower flow path allowing cold air to be delivered to the lower end of the first duct assembly from the circumferential flow path may be formed.

In addition, in the refrigerator of the present disclosure, the first discharge part may be formed at a boundary portion between the circumferential flow path and the upper flow path. Accordingly, portion of the cold air flowing to the upper flow path along the circumferential flow path may be supplied into the storage compartment through the first discharge part.

Furthermore, in the refrigerator of the present disclosure, the lower flow path defined by the third flow guide may be configured such that cold air flows from a position located directly under the blower fan toward the lower portion of the center of the first duct assembly. Accordingly, the cold air guided to the lower flow path after flowing along the circumferential flow path may be supplied to the center portion of the lower side of the inside of the storage compartment after flowing downward along the center portion of the first duct assembly.

Additionally, in the refrigerator of the present disclosure, the lower end part of the first flow guide may be configured to cross at least half of a portion located between the circumferential flow path and the lower flow path. Accordingly, portion of cold air flowing along the circumferential flow path may be supplied to the lower flow path.

In addition, in the refrigerator of the present disclosure, a drain hole may be foiled in the lower end part of the first flow guide. Accordingly, water drained through the drain hole may flow down into the lower flow path defined by the third flow guide. Accordingly, cold air discharged through the drain hole may also be supplied into the lower flow path, so the loss of the flow amount of the cold air may be reduced.

As described above, in the refrigerator of the present disclosure, due to the provision of the first discharge part, cold air may be supplied into the storage compartment located at the front side of a portion at which the blower fan is located, thereby reducing temperature distribution difference between upper and lower sections inside the storage compartment.

In addition, in the refrigerator of the present disclosure, due to the provision of the third discharge part, cold air may be sufficiently supplied even to the center portion of the lower section of the storage compartment, thereby improving temperature distribution in the space of the lower section inside the storage compartment.

Furthermore, in the refrigerator of the present disclosure, the lower flow path may be configured along the center portion of the first duct assembly, thereby having a recessed part at each of the opposite sides of the lower flow path and increasing lower storage space as largely as the size of such a recessed part.

Additionally, in the refrigerator of the present disclosure, the drain hole configured to drain water produced at the surrounding area of the blower fan may be configured to communicate with the inside of the lower flow path, and thus despite the discharge of cold air to the drain hole, the cold air may be discharged into the lower flow path, thereby preventing the loss of the flow amount of the cold air.

In addition, in the refrigerator of the present disclosure, condensate water drained into the lower flow path may be immediately discharged to a portion located under the evaporator, and may be stored in a condensate water reservoir, thereby preventing the condensate water discharged from the first duct assembly from being condensed on the evaporator.

Furthermore, in the refrigerator of the present disclosure, the second part of the first duct assembly connected to the second duct assembly may be configured to gently incline from the blower fan, and thus cold air may efficiently flow without the rapid change of the flow direction of the cold air, thereby preventing noise and improving consumption efficiency.

Additionally, in the refrigerator of the present disclosure, the filtering member may be provided in the introduction duct, thereby removing the odor components and foreign matter contained in cold air flowing to the evaporator.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinafter, an exemplary embodiment of the present disclosure will be described in detail with reference to FIGS. 1 to 15.

Figure 1:
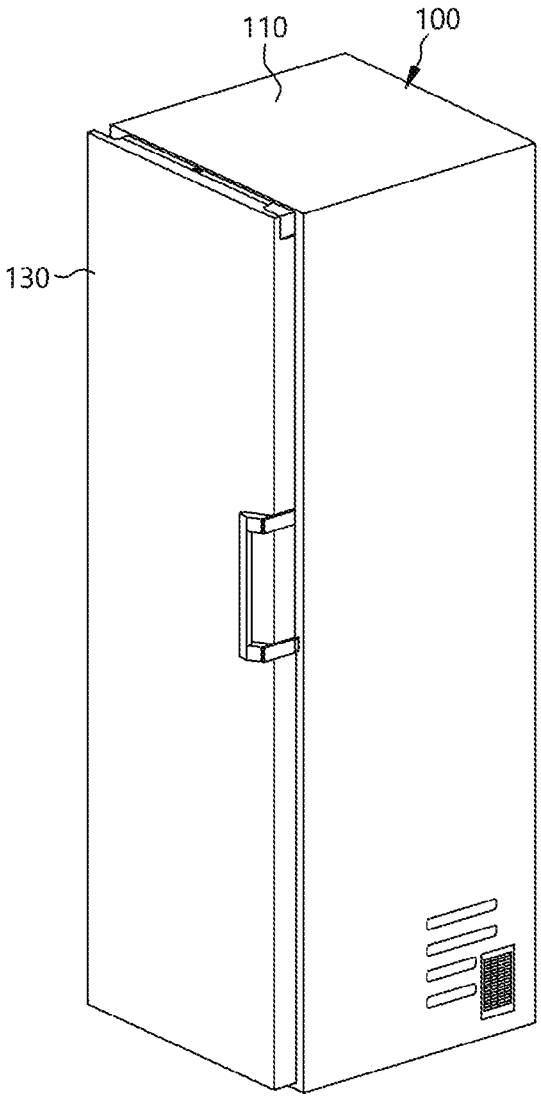
FIG. 1 is a perspective view illustrated to describe the exterior structure of a refrigerator according to an embodiment of the present disclosure.
Figure 2:
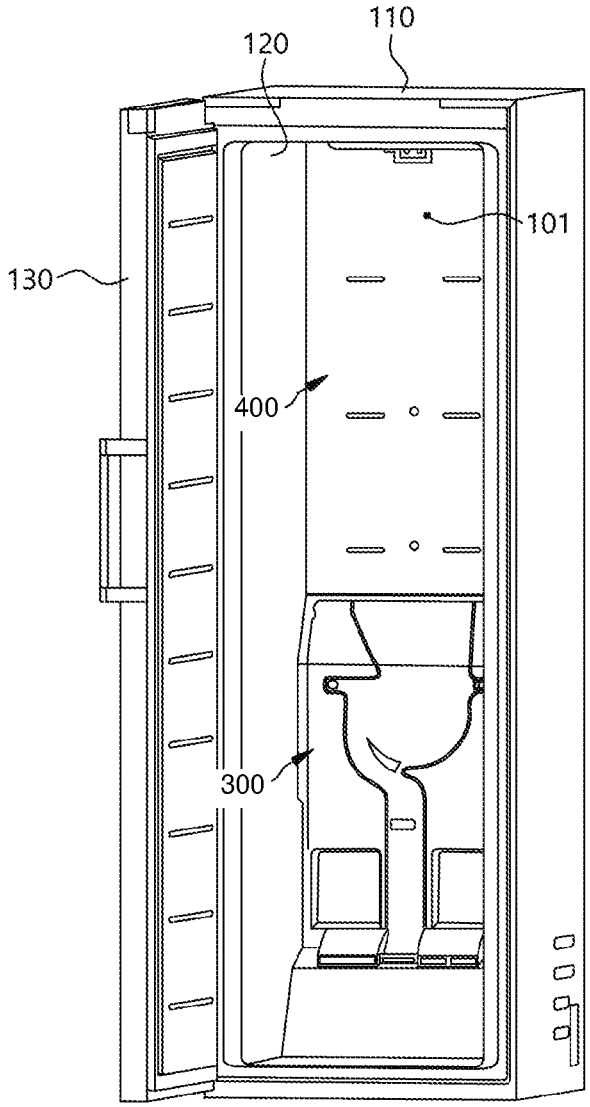
FIG. 2 is a perspective view illustrating the open state of a door to describe the inside of the refrigerator according to the embodiment of the present disclosure.
Figure 3:
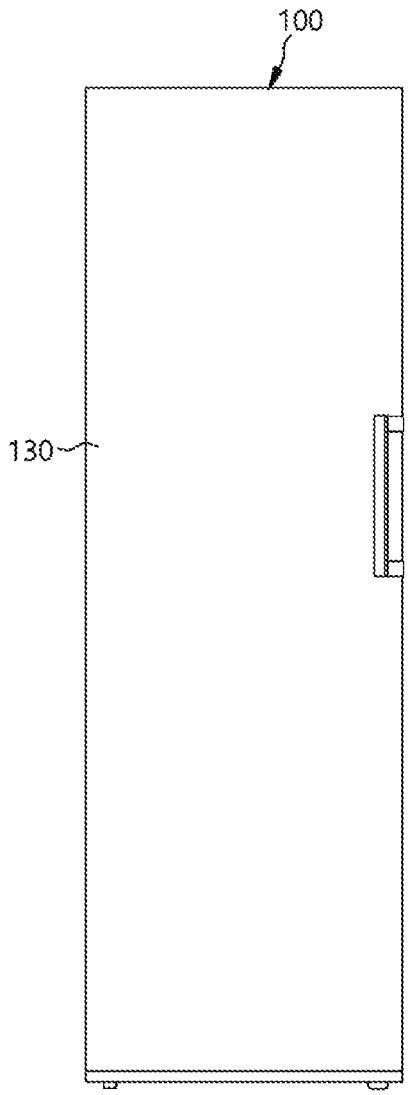
FIG. 3 is a front view illustrated to describe the exterior structure of the refrigerator according to the embodiment of the present disclosure.
Figure 4:
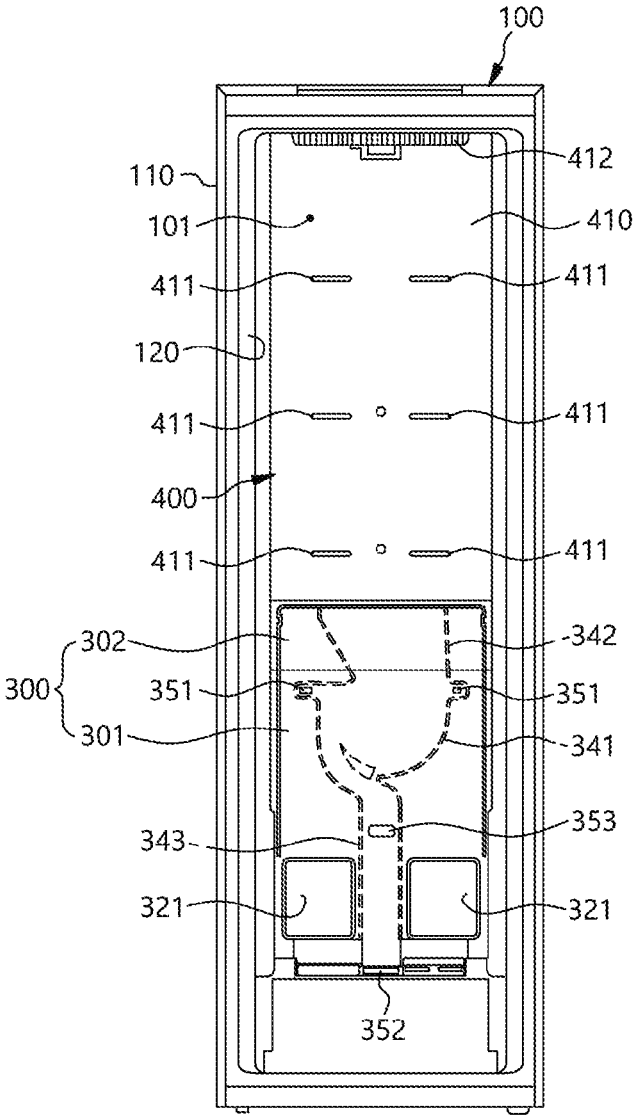
FIG. 4 is a front view illustrating the omitted state of the door to describe the inside of the refrigerator according to the embodiment of the present disclosure.
Figure 5:
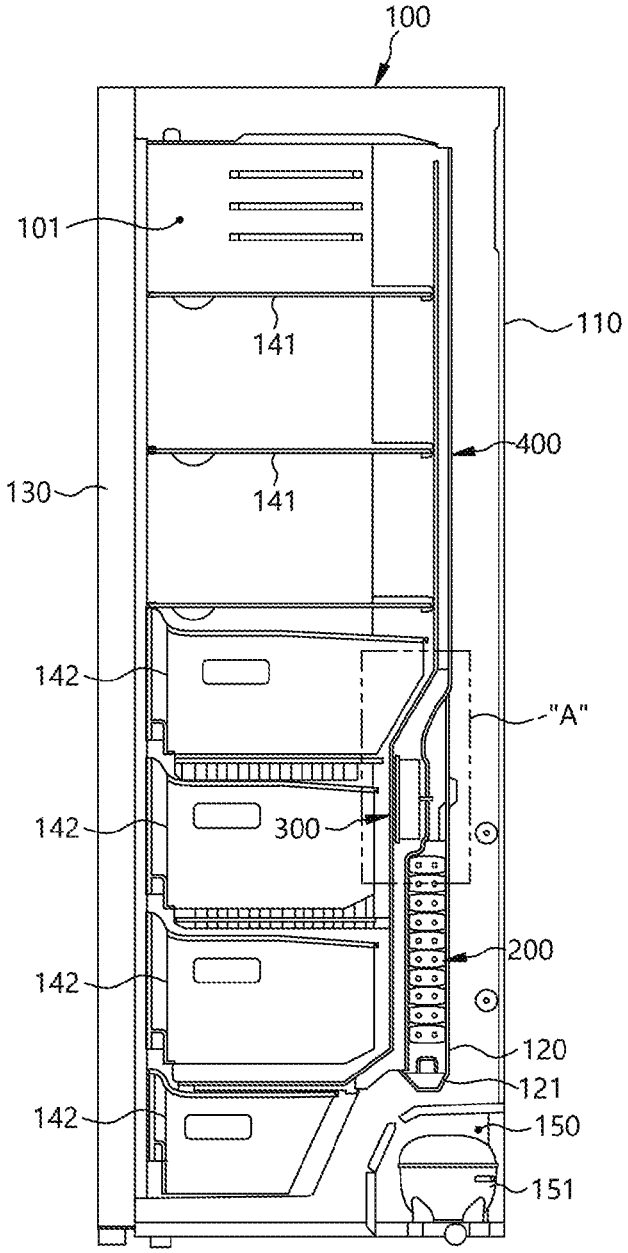
FIG. 5 is a sectional view illustrated to describe the structure of guiding the flow of cold air in the refrigerator according to the embodiment of the present disclosure.

FIG. 1 is a perspective view illustrated to describe the exterior structure of a refrigerator according to an embodiment of the present disclosure; FIG. 2 is a perspective view illustrating the open state of a door to describe the inside of the refrigerator according to the embodiment of the present disclosure; FIG. 3 is a front view illustrated to describe the exterior structure of the refrigerator according to the embodiment of the present disclosure; FIG. 4 is a front view illustrating the omitted state of the door to describe the inside of the refrigerator according to the embodiment of the present disclosure; and FIG. 5 is a sectional view illustrated to describe the structure of guiding the flow of cold air in the refrigerator according to the embodiment of the present disclosure. As illustrated in these drawings, the refrigerator of the present disclosure according to the embodiment may be provided as a single refrigerator or a convertible refrigerator in which at least two refrigerators may be arranged freely.

In addition, in the refrigerator according to the embodiment of the present disclosure, due to the provision of a first discharge part, temperature distribution difference between the upper section (upper space relative to the center portion of the inside of the storage compartment) of the inside of the storage compartment and the lower section (lower space relative to the center portion of the inside of the storage compartment) of the inside of the storage compartment may be reduced.

Additionally, in the refrigerator according to the embodiment of the present disclosure, water produced at a surrounding area of a blower fan may flow into a flow path formed under the blower fan, which may reduce the loss of the flow amount of cold air.

Each configuration of such a refrigerator according to the embodiment of the present disclosure will be described further in detail.

First, the refrigerator according to the embodiment of the present disclosure may include a cabinet 100.

The cabinet 100 may be configured to constitute the exterior of the refrigerator and to have the storage compartment 101.

The cabinet 100 may be configured as a casing open forward.

As illustrated in FIGS. 2, 4, and 5, such a cabinet 100 may include an outer casing 110 constituting an outer wall of the cabinet 100 and an inner casing 120 constituting an inner wall of the cabinet 100.

In this case, the storage compartment, which is a space in which goods are stored, may be located at the front of an evaporator 200 and at the front of each of first and second duct assemblies 300 and 400, the evaporator 200 and the first and second duct assemblies 300 and 400 being located in the inner space of the inner casing 120.

Although not shown, an insulator or foam may be filled between the outer casing 110 and the inner casing 120.

Of course, the outer casing 110 and the inner casing 120 of the cabinet 100 may be configured to be integrated with each other.

In addition, the door 130 may be installed at the open front surface of the cabinet 100 and may be configured to open and close the storage compartment. In this case, the door 130 may be a rotary door or a drawer-type door.

The storage compartment may be provided as one storage compartment. In this case, as illustrated in FIG. 5, the one storage compartment 101 may be provided with a plurality of shelves 141 or drawer-type storage boxes 142, and thus may be used by being divided into multiple storage spaces.

Next, the refrigerator according to the embodiment of the present disclosure may include a machine room 150.

A compressor 151 (see FIG. 5) and a condenser (not shown) constituting the refrigeration cycle may be provided in the machine room 150.

Such a machine room 150 may be located at a rear bottom portion of space between the outer casing 110 and the inner casing 120 constituting the cabinet 100.

In this case, the lower edge of the rear side of the inner casing 120 constituting the cabinet 100 may be configured by inclining to avoid interference with space in which the machine room 150 is provided.

Next, the refrigerator according to the embodiment of the present disclosure may include the evaporator 200.

The evaporator 200 may be configured to cool cold air by exchanging heat between a refrigerant flowing inside a refrigerant tube and the cold air flowing outside the refrigerant tube.

The cold air may be air, gas including air, or gas which does not contain air. In the embodiment of the present disclosure, the cold air may be air as an example, and air heat-exchanged while passing through the evaporator 200 may be cold air.

As illustrated in FIG. 5, the evaporator 200 may be located at the rear portion of the inside of the inner casing 120 and at the upper side of the machine room 150.

In this case, in each portion of the inner casing 120, a portion facing the evaporator 200 may be bent to be in close contact with the evaporator 200. Accordingly, cold air may be prevented from flowing to a portion between the evaporator 200 and the inner casing 120.

In addition, the evaporator 200 may vary in size depending on the intended use of the refrigerator.

For example, an evaporator used in a refrigerator for refrigeration may be configured to be smaller than an evaporator used in a refrigerator for freezing.

Meanwhile, a structure for cooling the cold air may not be limited to the evaporator 200.

That is, it may be possible to cool cold air by various other structures without cooling the cold air by using the heat exchange operation of the evaporator 200.

For example, although not shown, it may also be possible to cool cold air by using a thermoelectric element.

Next, the refrigerator according to the embodiment of the present disclosure may include a first duct assembly 300. The first duct assembly 300 may be a duct which provides a flow path through which cold air flows.

Figure 7:
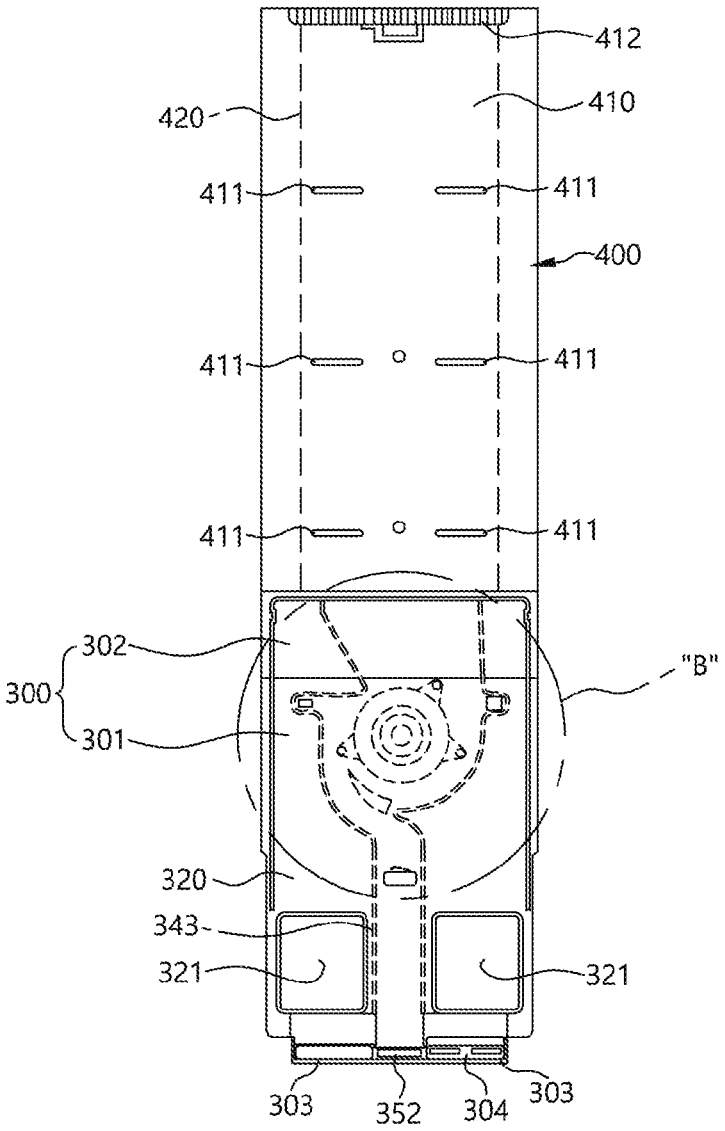
FIG. 7 is a front view illustrating the coupled state of a first duct assembly and a second duct assembly to each other constituting the refrigerator according to the embodiment of the present disclosure.

In addition, as illustrated in FIGS. 5 and 7, the first duct assembly 300 may be used to constitute a rear wall surface of a portion of the inside of the storage compartment 101.

In the embodiment of the present disclosure, as an example, the first duct assembly 300 may be configured to constitute the rear wall surface of the lower section (lower space relative to the center portion of the inside of the storage compartment) of the inside of the storage compartment 101.

Figure 6:
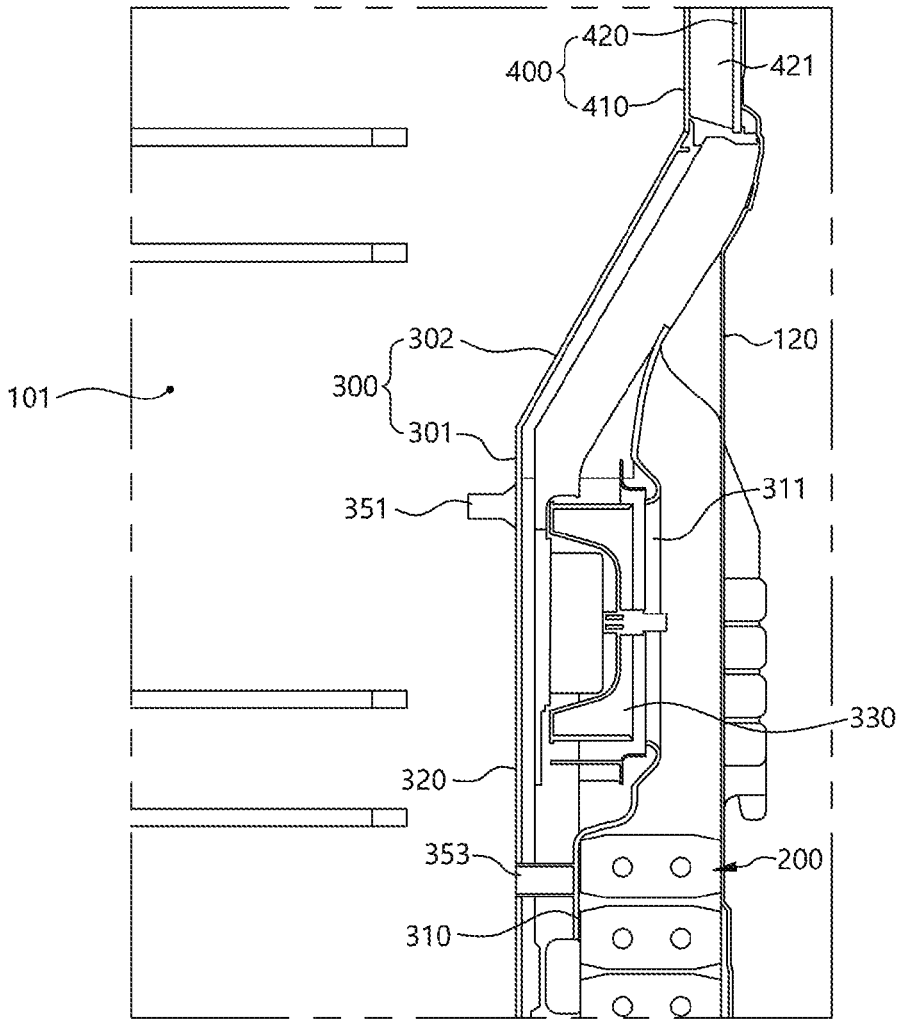
FIG. 6 is an enlarged view of "A" part of FIG. 5.

As illustrated in FIG. 6, the first duct assembly 300 may be configured to be spaced apart from the inner casing 120 by thickness of the evaporator 200.

Accordingly, space in which the evaporator 200 is installed may be defined between the first duct assembly 300 and the inner casing 120.

Figure 9:
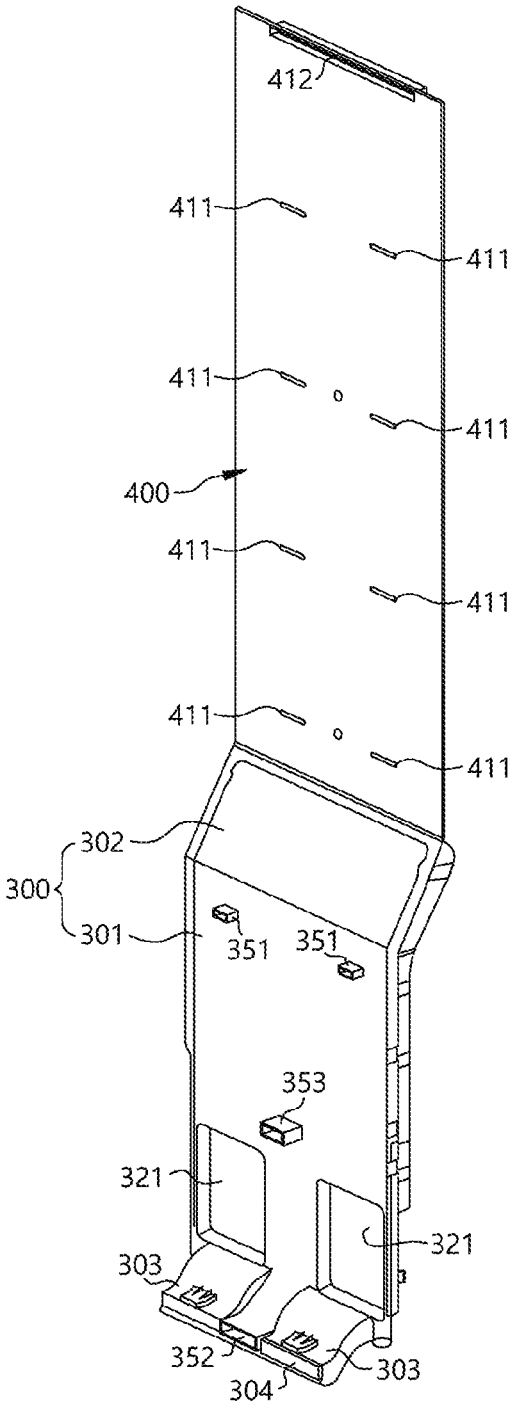
FIG. 9 is a perspective view illustrating the coupled state of the first duct assembly and the second duct assembly constituting the refrigerator according to the embodiment of the present disclosure.
Figure 10:
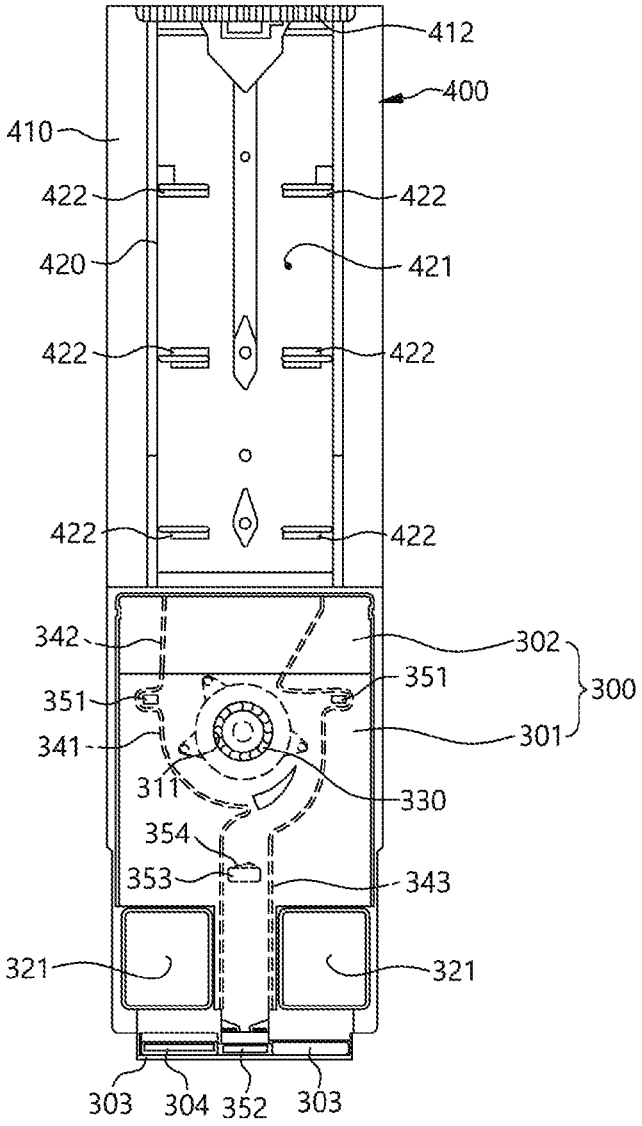
FIG. 10 is a rear view illustrating the coupled state of the first duct assembly and the second duct assembly constituting the refrigerator according to the embodiment of the present disclosure.
Figure 11:
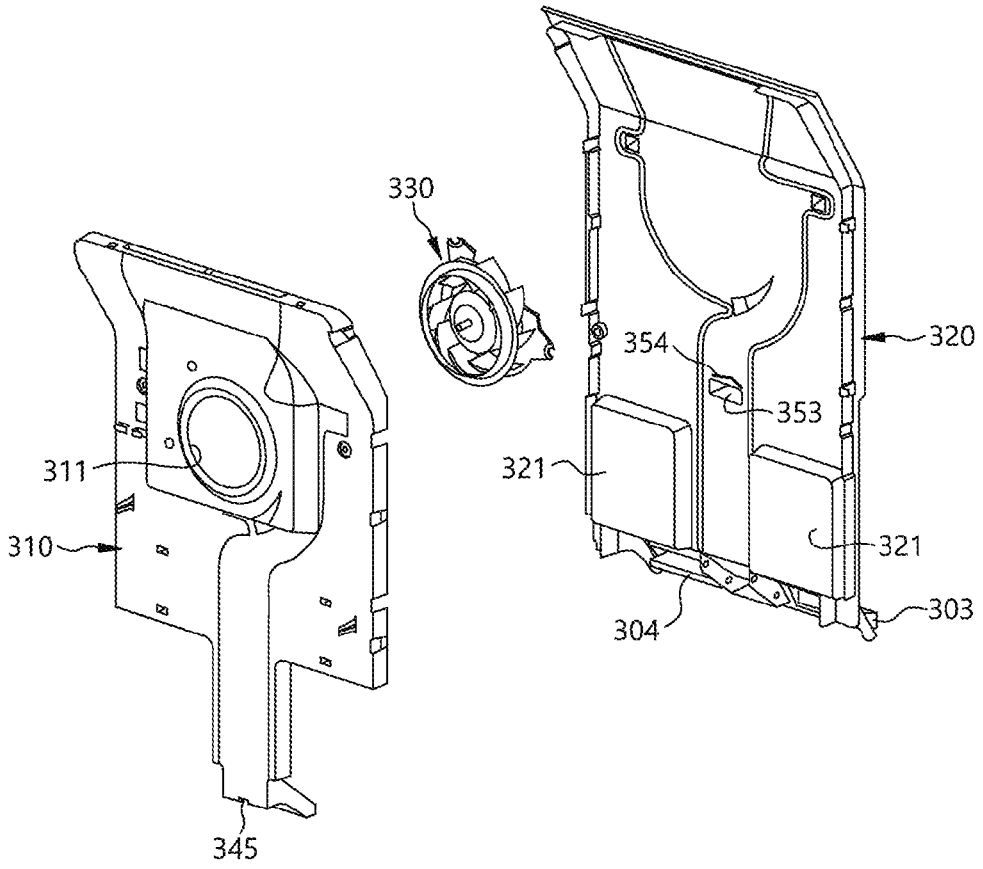
FIG. 11 is an exploded perspective view illustrating the state of the first duct assembly seen from the front thereof to describe the first duct assembly constituting the refrigerator according to the embodiment of the present disclosure.
Figure 12:
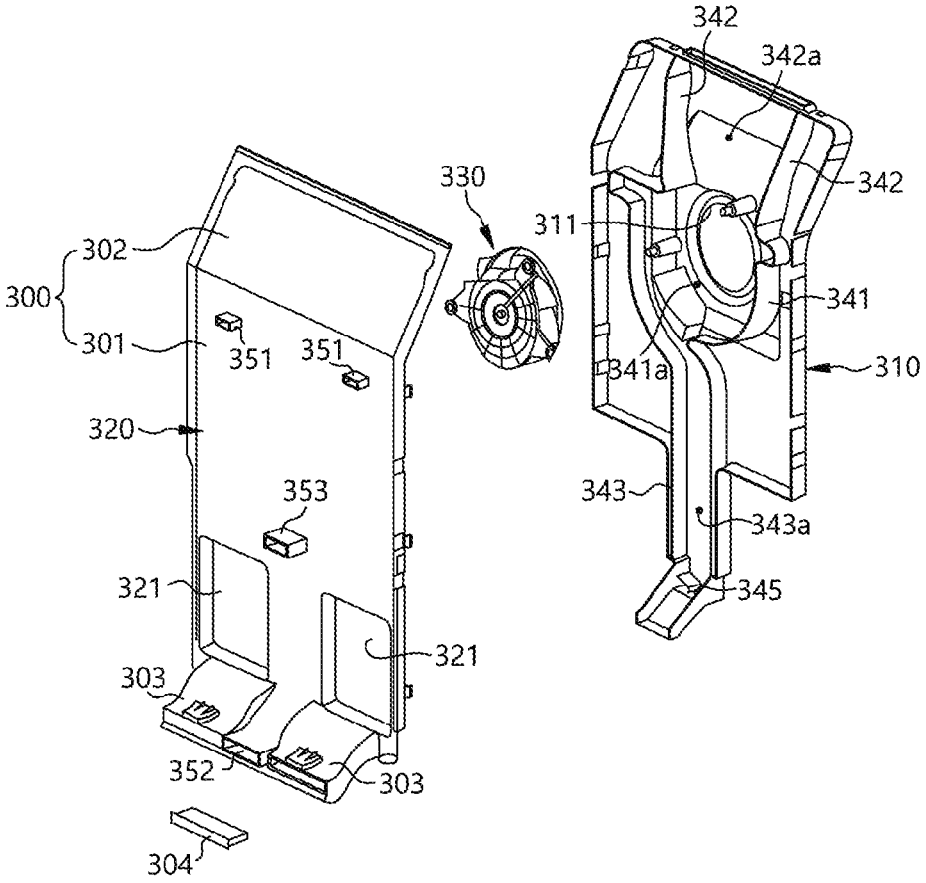
FIG. 12 is an exploded perspective view illustrating the state of the first duct assembly seen from the rear thereof to describe the first duct assembly constituting the refrigerator according to the embodiment of the present disclosure.

In FIGS. 9 and 10, the first duct assembly 300 is illustrated to be coupled to a second duct assembly 400, and in FIGS. 11 and 12, a specific configuration of the first duct assembly 300 is illustrated.

Such a first duct assembly 300 may be composed of the first part and a second part 302.

The first part 301 may be a part to which the blower fan 330 is coupled, the first part being installed to cover the evaporator 200, and the second part 302 may be a part extending upward from the first part 301 and being connected to the second duct assembly 400 to be described later.

Particularly, the second part 302 may be configured to gradually incline from the upper end of the first part 301 toward the lower end of the second duct assembly 400.

That is, due to the gently inclined structure of the second part 302 described above, the flow resistance of cold air flowing from the first duct assembly 300 to the second duct assembly 400 may be reduced as much as possible.

The second part 302 and the second duct assembly 400 can be coupled to each other in various ways, such as screwing, bonding, locking, and hooking.

Meanwhile, the blower fan 330 may be provided at the upper portion of the first part 301. Accordingly, cold air blown by the blower fan 330 may be sufficiently supplied to the upper end of the second duct assembly 400.

In addition, an introduction duct 303 may be provided at the lower end of the first part 301.

The introduction duct 303 may be formed at each of opposite sides of the lower end of the first part 301.

The introduction duct 303 may be configured as the inclined structure of gradually protruding forward from the lower end of the front surface of the first duct assembly 300 downward.

More specifically, the introduction duct 303 may be configured to have the same inclination as or an inclination similar to the inclination of the rear edge of the bottom surface of the inner casing 120 formed by being bent for the provision of the machine room 150.

That is, cold air flowing to the lower part of the inside of the storage compartment 101 may be supplied to the cold air introduction side of the evaporator 200 by the guidance of the introduction duct 303 while the cold air flows along the bottom surface of the inner casing 120.

Particularly, a filtering member 304 may be provided in the introduction duct 303.

The filtering member 304 may be installed through the introduction duct 303 and may be located in the flow path between the introduction duct 303 and the bottom of the inner casing 120, and thus may function to filter odor components or foreign matter contained in cold air flowing toward the evaporator 200 after the cold air passes through the flow path.

In this case, the filtering member 304 may be detachably installed at the front of the introduction duct 303. Accordingly, the filtering member may be replaced or cleaned periodically by a user.

As illustrated in FIGS. 11 and 12, the first duct assembly 300 may include a shroud 310 and a grille plate 320.

Here, the shroud 310 may be configured to constitute the rear wall surface of the first duct assembly 300, and may be located at a side facing the evaporator 200. In this case, a cold air introduction hole 311 may be formed in the shroud 310 such that cold air is introduced into the first duct assembly 300.

In addition, the grille plate 320 may be a part constituting the front wall surface of the first duct assembly 300, and may be located to be exposed to the inside of the storage compartment 101. In some examples, the grille plate 320 may refer to a grille panel, which may be a part of a grille fan assembly.

The blower fan 330 may be located between the shroud 310 and the grille plate 320.

In this case, the blower fan 330 may be coupled to the shroud 310, or may be coupled to the grille plate 320. In the embodiment of the present disclosure, as an example, the blower fan 330 may be coupled to the cold air introduction hole 311 of the front surface of the shroud 310.

In addition, a flow path may be formed between the shroud 310 and the grille plate 320 so as to guide the flow of cold air.

That is, the cold air introduced to the cold air introduction hole 311 by the blower fan 330 may flow toward the upper end of the second duct assembly 400 or may flow downward by the guidance of the flow path.

The flow path may include a circumferential flow path 341*a* defined by a first flow guide 341.

The first flow guide 341 may be formed on any one surface of the surfaces of the shroud 310 and the grille plate 320 facing each other. In the embodiment of the present disclosure, as an example, the first flow guide 341 may protrude from the front surface of the shroud 310 such that the first flow guide 341 may be in close contact with the rear surface of the grille plate 320.

In addition, the first flow guide 341 may be configured to cover the circumference of the blower fan 330. The circumferential flow path 341*a* may be formed between the first flow guide 341 and the blower fan 330 and may guide the flow of cold air such that the cold air flows along the circumferential direction of the blower fan 330.

In addition, the flow path may include an upper flow path 342*a* defined by a second flow guide 342.

The second flow guide 342 may be formed on any one surface of the opposing surfaces of the shroud 310 and the grille plate 320 to each other. In the embodiment of the present disclosure, the second flow guide 342 may be configured by protruding from the front surface of the shroud 310 such that the second flow guide 342 may be in contact with the rear surface of the grille plate 320.

In addition, the second flow guide 342 may be configured by extending upward from the opposite ends of the first flow guide 341, and the upper flow path 342*a* may be defined by such a second flow guide 342.

In this case, the upper flow path 342*a* may be configured to guide the flow of cold air from the upper portion of the blower fan 330 to a communication part of the blower fan 330 with the second duct assembly 400 located above the upper portion of the blower fan 330.

Particularly, the cold air introduction portion of the upper flow path 342*a* may be configured to have a width narrower than the cold air exit portion thereof. That is, cold air supplied to the upper flow path 342*a* by the blower fan 330 may flow by gradually expanding upward.

Accordingly, cold air may efficiently flow upward along the opposite portions of a cold air flow path 421 formed in the second duct assembly 400 to be described later.

In addition, the flow path may include a lower flow path 343*a* defined by a third flow guide 343.

The third flow guide 343 may be formed on any one surface of the opposing surfaces of the shroud 310 and the grille plate 320 to each other. In the embodiment of the present disclosure, as an example, the third flow guide 343 may be formed by protruding from the rear surface of the shroud 310.

Furthermore, the third flow guide 343 may be configured to extend downward from the first flow guide 341. The lower flow path 343*a* may be defined by such a third flow guide 343.

In this case, the lower flow path 343*a* may be configured to guide the flow of cold air from a portion under the blower fan 330 to the lower end of the first duct assembly 300.

More specifically, the lower flow path 343*a* defined by the third flow guide 343 may be configured to guide cold air such that the cold air flows from a portion directly under the center of the blower fan 330 toward the lower end of the center of the first duct assembly 300.

In addition, the upper end of the lower flow path 343*a* defined by the third flow guide 343 may be configured to communicate with any one side of the circumferential flow path 341*a*. That is, cold air flowing along the circumferential flow path 341*a* may flow toward the lower end of the first duct assembly 300 after being introduced into the lower flow path 343*a* through the communication portion of the circumferential flow path 341*a* with the lower flow path 343*a*, the communication portion being located at a side located along the circulating direction of the cold air.

Meanwhile, the lower end part of the first flow guide 341 may be configured to cross at least half of a portion located between the circumferential flow path 341*a* and the lower flow path 343*a*. Accordingly, only of cold air flowing along the circumferential flow path 341*a* may flow toward the lower flow path 343*a*.

Figure 8:
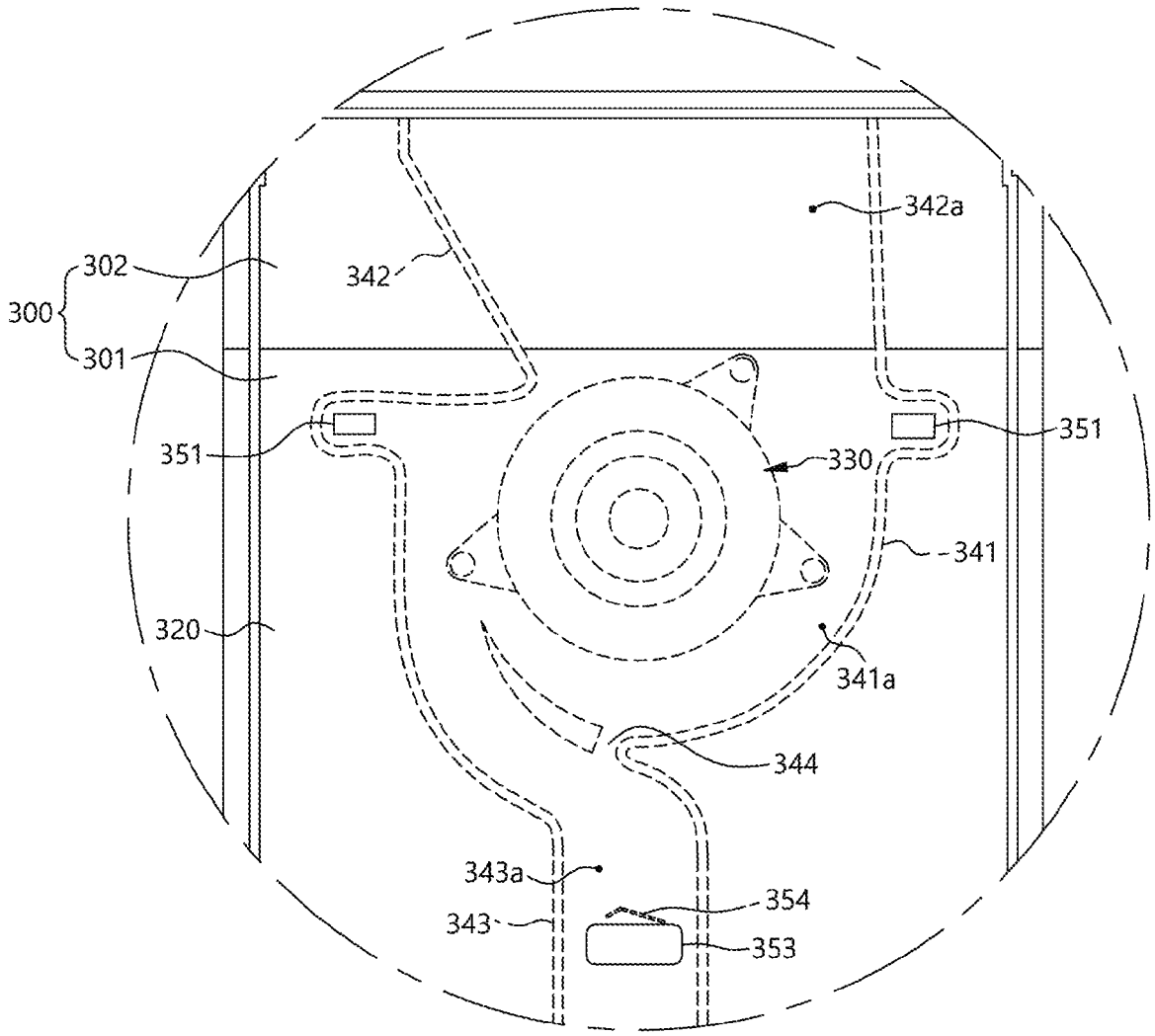
FIG. 8 is an enlarged view of "B" part of FIG. 7.

As illustrated in FIG. 8, a drain hole 344 may be formed in the first flow guide 341.

Particularly, in order to drain water flowing down from the blower fan 330 to the lower flow path 343*a*, the drain hole 344 may be formed through the lower end of the first flow guide 341 located at a position located directly under the blower fan 330 such that the drain hole 344 communicates with the inside of the lower flow path 343*a*.

That is, condensate water flowing down to the first flow guide 341 located along the circumference of the blower fan 330 may be efficiently discharged to the lower flow path 343*a* through the drain hole 344 described above.

Of course, the drain hole 344 may communicate with the inside of the lower flow path 343*a*, so cold air circulated along the circumference of the blower fan 330 by the operation of the blower fan 330 may be discharged to the drain hole 344.

However, the cold air may be supplied into the lower flow path 343*a*, but may not be discharged to the outside, so the loss of the flow amount of the cold air may be prevented.

Meanwhile, discharge parts discharging cold air to the storage compartment 101 may be formed in the first duct assembly 300.

That is, while cold air introduced into the first duct assembly 300 flows along each of the flow paths 341*a*, 342*a*, and 343*a*, the cold air may be supplied to the lower space of the inside of the storage compartment 101 through the discharge parts.

In FIG. 4 and FIGS. 6 to 12, each of the discharge parts is illustrated.

Such a discharge part may include the first discharge part 351.

The first discharge part 351 may be a portion through which cold air is discharged to the space of the inside of the storage compartment 101 located at height at which the blower fan 330 is located.

The first discharge part 351 may be formed at the grille plate 320.

In this case, the first discharge part 351 may be configured as a simple hole, or as a tube body protruding forward (in a direction toward the storage compartment) from the grille plate 320.

In the embodiment of the present disclosure, as an example, the first discharge part 351 is configured as a tube body protruding toward the front of the grille plate 320. That is, cold air discharged through the first discharge part 351 may be discharged straight and may be sufficiently supplied to the front portion of the inside of the storage compartment 101.

The first discharge part 351 may be configured to be located at a side higher than the center of the blower fan 330.

Specifically, the first discharge part 351 may be located to be adjacent to the boundary portion between the first part 301 and the second part 302.

More specifically, the first discharge part 351 may be formed at the boundary portion between the circumferential flow path 341*a* defined by the first flow guide 341 and the upper flow path 342*a* defined by the second flow guide 342.

That is, since the first discharge part 351 is located at the position described above, the cold air flowing in the rotating direction of the blower fan 330 may be efficiently supplied to the first discharge part 351 and be discharged therethrough.

Particularly, when the shroud 310 and the grille plate 320 are coupled to each other, a portion of the first flow guide 341 formed at the shroud 310 may be configured to cover the upper portion and one side (a side located relatively far from the blower fan) of the first discharge part 351 formed in the grille plate 320.

Accordingly, portion of cold air flowing by circulating in the circumferential flow path 341*a* of the circumference of the blower fan 330 due to the operation of the blower fan 330 may be efficiently discharged to the first discharge part 351 by the guidance of the first flow guide 341.

Of course, due to the first discharge part 351 located at the position described above, the cold air may be supplied to the uppermost side in the lower section (lower space relative to the center of the storage compartment) of the inside of the storage compartment 101 located at height at which the first duct assembly 300 is located.

The first discharge part 351 may be provided at each of the opposite sides of the blower fan 330.

Specifically, the first discharge part 351 may be formed at each of the opposite sides of a portion at which the blower fan 330 is located in the first part 301 of the first duct assembly 300.

That is, the two first discharge parts 351 may be configured such that cold air is supplied toward the opposite sides of the inside of the storage compartment 101, so temperature distribution inside the storage compartment 101 may be improved.

In addition, the discharge part may include a second discharge part 352.

The second discharge part 352 may be formed at the lower end portion of the first duct assembly 300 such that cold air is supplied to the side of the open upper surface of the storage box 142 located at the lowest side of the inside of the storage compartment 101.

Specifically, the second discharge part 352 may be formed at the lower end portion of the lower flow path 343*a* defined by the third flow guide 343 such that cold air flowing along the lower flow path 343*a* may be supplied to lower space in the lower section of the inside of the storage compartment 101.

Particularly, the second discharge part 352 may be provided at the center portion of the lower end of the first duct assembly 300.

That is, the second discharge part 352 may be located between the introduction ducts 303 provided at the opposite sides of the lower end of the first duct assembly 300.

Due to the configuration of the second discharge part 352 described above, a recessed part 321 having a sufficient size may be formed at the grille plate 320 by being recessed rearward therefrom.

That is, the opposite sides of the lower flow path 343*a* defined by the third flow guide 343 may be provided as empty areas. Accordingly, the recessed part 321 may be provided at each of the empty areas, so the storage space of the lower section of the inside of the storage compartment 101 may be further expanded.

Of course, although not shown, if storage space is not considered, the lower flow path 343*a* may be configured to be branched to opposite sides from a portion located under the blower fan 330 and to extend to a portion directly above each of the introduction ducts 303 such that cold air is discharged toward the front of the introduction duct 303.

Meanwhile, the lower end of the lower flow path 343*a* defined by the third flow guide 343 may be configured to be bent forward.

That is, when it is considered that the lower end of the grille plate 320 is configured to gradually incline forward due to the introduction duct 303, the second discharge part 352 configured between the ends of the two introduction ducts 303 may be located at a side more forward than the blower fan 330.

In consideration of this, the lower end of the lower flow path 343*a* may be bent forward, and thus may be configured to have the same inclination (or curve) as the inclination (or curve) of the lower end of the grille plate 320 and to protrude to the second discharge part 352.

Particularly, a water discharge hole 345 may be formed in the bent portion of the lower end of the lower flow path 343*a*. In this case, the water discharge hole 345 may be a hole configured such that water (for example, condensate water) flowing down along the lower flow path 343*a* is discharged to a condensate water reservoir 121 located under the evaporator 200.

That is, due to the water discharge hole 345, water flowing down to the lower flow path 343*a* may not be discharged into the storage compartment 101, but may efficiently be discharged to a side at which the condensate water reservoir 121 is located.

Of course, since some of the cold air flowing along the lower flow path 343*a* is discharged through the water discharge hole 345, the loss of the flow amount of the cold air may occur.

However, since the water discharge hole 345 is not located to be directly influenced by the blower fan 330 as the drain hole 344 is influenced, the flow amount of the cold air discharged through the water discharge hole 345 may be still smaller than the flow amount of the cold air discharged through the drain hole 344.

In addition, the discharge part may include a third discharge part 353.

The third discharge part 353 may be provided at the center portion of the first duct assembly 300, and may be configured to discharge cold air into the storage compartment 101 located at the front of the third discharge part 353.

Specifically, the third discharge part 353 may be configured such that cold air is supplied to the space of the storage compartment 101 located between the first discharge part 351 and the second discharge part 352 in the lower section of the inside of the storage compartment 101.

Such a third discharge part 353 may be configured as a simple hole, or as a tube body protruding forward (in a direction toward the storage compartment) from the grille plate 320.

In the embodiment of the present disclosure, as an example, the third discharge part 353 is configured as a tube body protruding forward from the grille plate 320. That is, cold air discharged through the third discharge part 353 may be discharged straight, and may be sufficiently supplied to the front portion of the inside of the storage compartment 101.

Particularly, when the shroud 310 is coupled to the grille plate 320, the third discharge part 353 may be configured to be located in the lower flow path 343*a* defined by the third flow guide 343. That is, some of cold air flowing along the lower flow path 343*a* may pass through the third discharge part 353, and may be supplied into the storage compartment 101.

In addition, a limiting protrusion 354 may be formed in the first duct assembly 300, the limiting protrusion 354 limiting the flow amount of cold air flowing to the third discharge part 353.

The limiting protrusion 354 may be located directly above the third discharge part 353, and may be configured to block at least some of cold air flowing downward from the upper side of the limiting protrusion 354 such that the cold air passes across the third discharge part 353.

Specifically, the limiting protrusion 354 may be located directly above the third discharge part 353 of the rear surface of the grille plate 320.

That is, the cold air passing across the third discharge part 353 while flowing downward along the lower flow path 343*a* may be influenced by the limiting protrusion 354, so the amount of the cold air flowing to the third discharge part 353 may be controlled.

In this case, the flow amount of the cold air to be discharged to the third discharge part 353 may be changed according to the extent to which the limiting protrusion 354 blocks the third discharge part 353 and according to the protruding height of the limiting protrusion 354.

Next, the refrigerator according to the embodiment of the present disclosure may include the second duct assembly 400.

The second duct assembly 400 may be a duct which provides a flow path through which cold air flows.

The second duct assembly 400 is illustrated in FIGS. 2, 4, 5, 7, 9, and 10.

The second duct assembly 400 may be used to constitute a rear wall surface of a portion of the inside of the storage compartment 101. In the embodiment of the present disclosure, as an example, the second duct assembly 400 may be configured to constitute the rear wall surface of the upper section (upper space relative to the center portion of the inside of the storage compartment) of the inside of the storage compartment 101.

In this case, the second duct assembly 400 may be provided by being manufactured separately from the first duct assembly 300, or may be provided by being manufactured to be integrated with the first duct assembly 300.

In the embodiment of the present disclosure, as an example, after the second duct assembly 400 is manufactured separately from the first duct assembly 300, the second duct assembly 400 may be coupled to the first duct assembly 300.

Such a second duct assembly 400 may include a multi duct 410 and a flow duct 420.

The multi duct 410 may be provided as a wall surface exposed to the inside of the storage compartment 101, and a plurality of cold air discharge parts 411 may be formed in the wall surface.

The cold air discharge parts 411 may be configured to discharge cold air to each storage space (space between a shelf and a shelf, or space between a shelf and the storage box) located inside the storage compartment 101.

The flow duct 420 may be coupled to the rear surface of the multi duct 410, and may be a part in which the cold air flow path 421 for guiding the flow of cold air is formed.

The cold air flow path 421 may be formed at the rear surface of the flow duct 420 by being recessed therefrom, and may be formed from the lower end surface of the flow duct 420 to the upper end surface thereof.

Particularly, the cold air flow path 421 may be configured to be connected to the second part 302 of the first duct assembly 300.

That is, the cold air flow path 421 may be configured to receive cold air flowing along the upper flow path 342*a* through the second part 302.

Communication holes 422 configured to discharge cold air flowing along the cold air flow path 421 to the storage compartment may be formed in the flow duct 420.

At least some holes of the communication holes 422 may be configured to correspond to the cold air discharge parts 411 of the multi duct 410.

That is, cold air flowing along the cold air flow path 421 may pass through the communication holes 422 and the cold air discharge parts 411 and may be discharged to the storage compartment 101.

An upper discharge part 412 discharging cold air toward the front thereof may be formed at each of the opposite sides of the upper end of the multi duct 410.

The two upper discharge parts 412 may be configured to be open such that the cold air flowing along the cold air flow path 421 of the flow duct 420 is discharged through the two upper discharge parts 412.

The upper surface of the upper discharge part 412 may be configured to be round.

That is, cold air flowing upward toward a part at which the upper discharge part 412 is located may be discharged toward the front of the upper discharge part 412 by the guidance of the round upper surface of the upper discharge part 412 in the process of passing through the upper discharge part 412.

Next, the process of the cold air flow caused by the refrigeration operation of the refrigerator according to the embodiment of the present disclosure described above will be described with reference to FIGS. 13 to 15.

Figure 13:
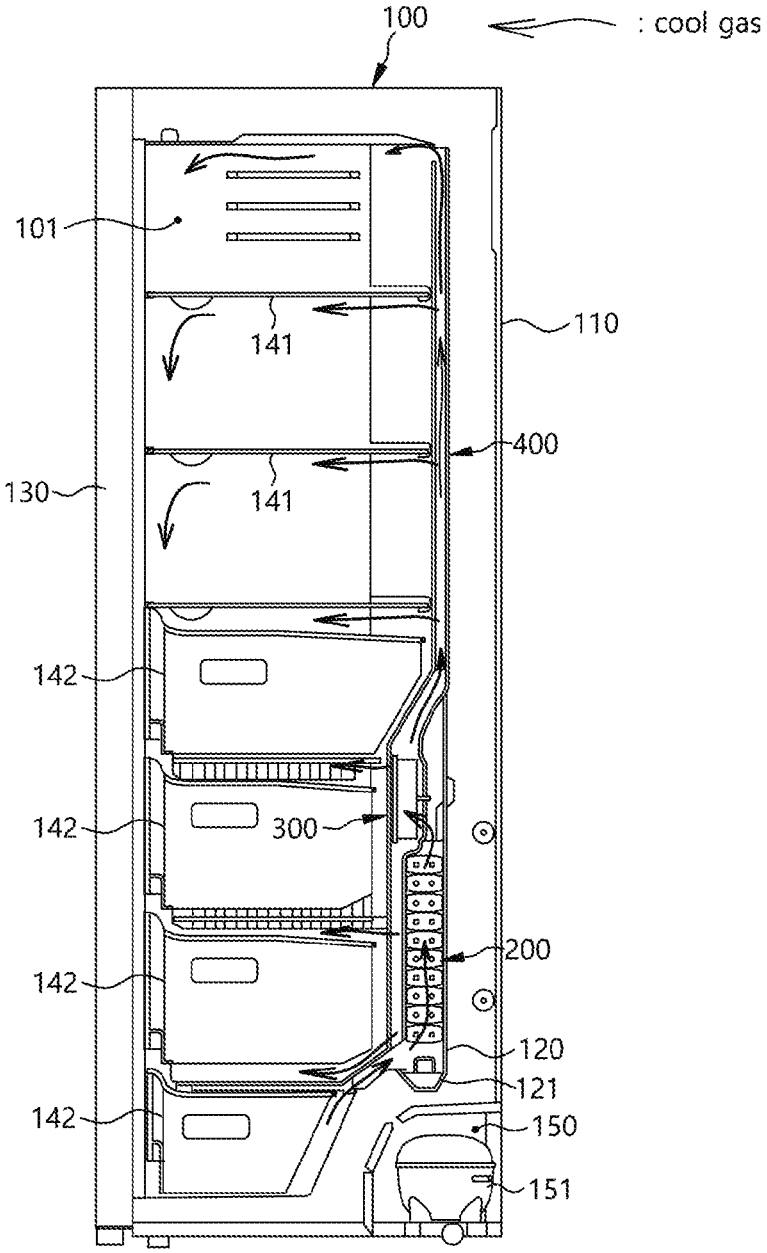
FIG. 13 is a sectional view illustrated to describe the flow state of cold air during the cooling operation of the refrigerator according to the embodiment of the present disclosure.
Figure 14:
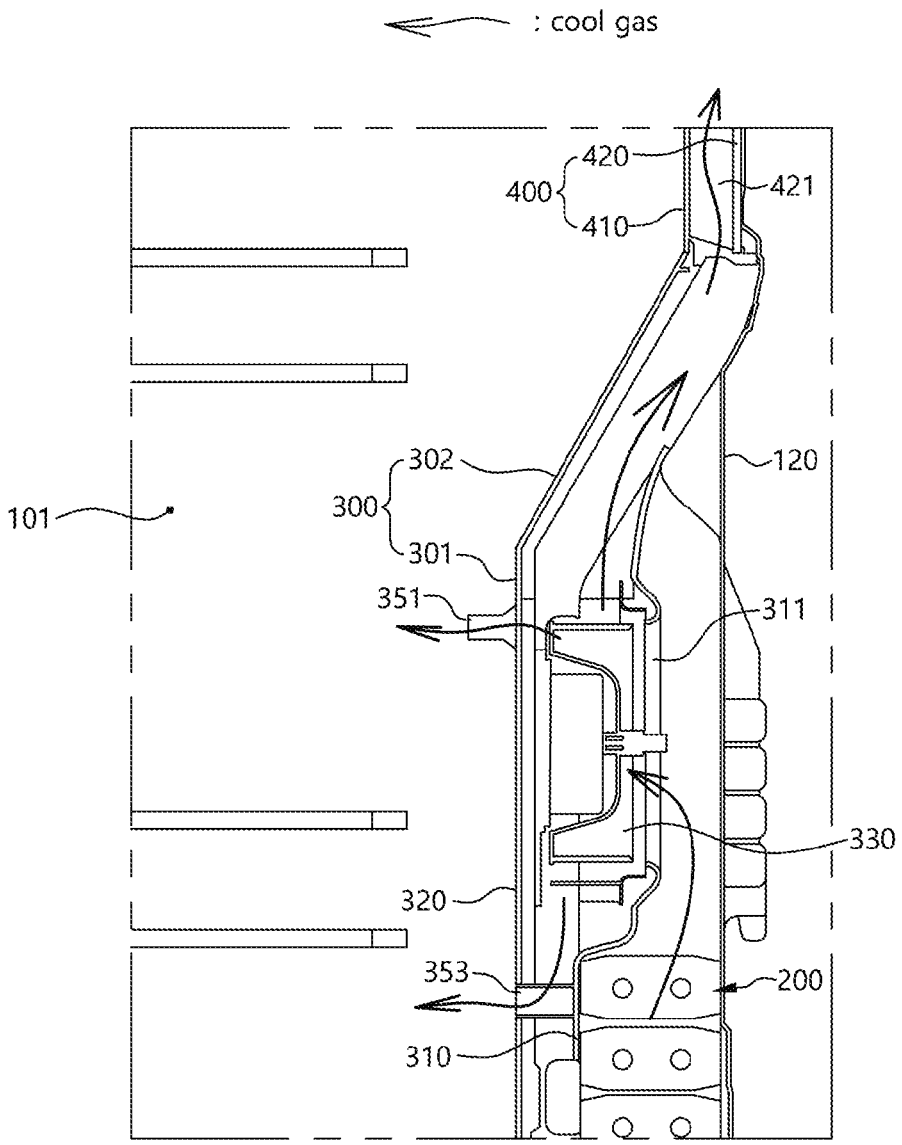
FIG. 14 is an enlarged view illustrated to describe the flow state of cold air in an important part of the first duct assembly during the cooling operation of the refrigerator according to the embodiment of the present disclosure.
Figure 15:
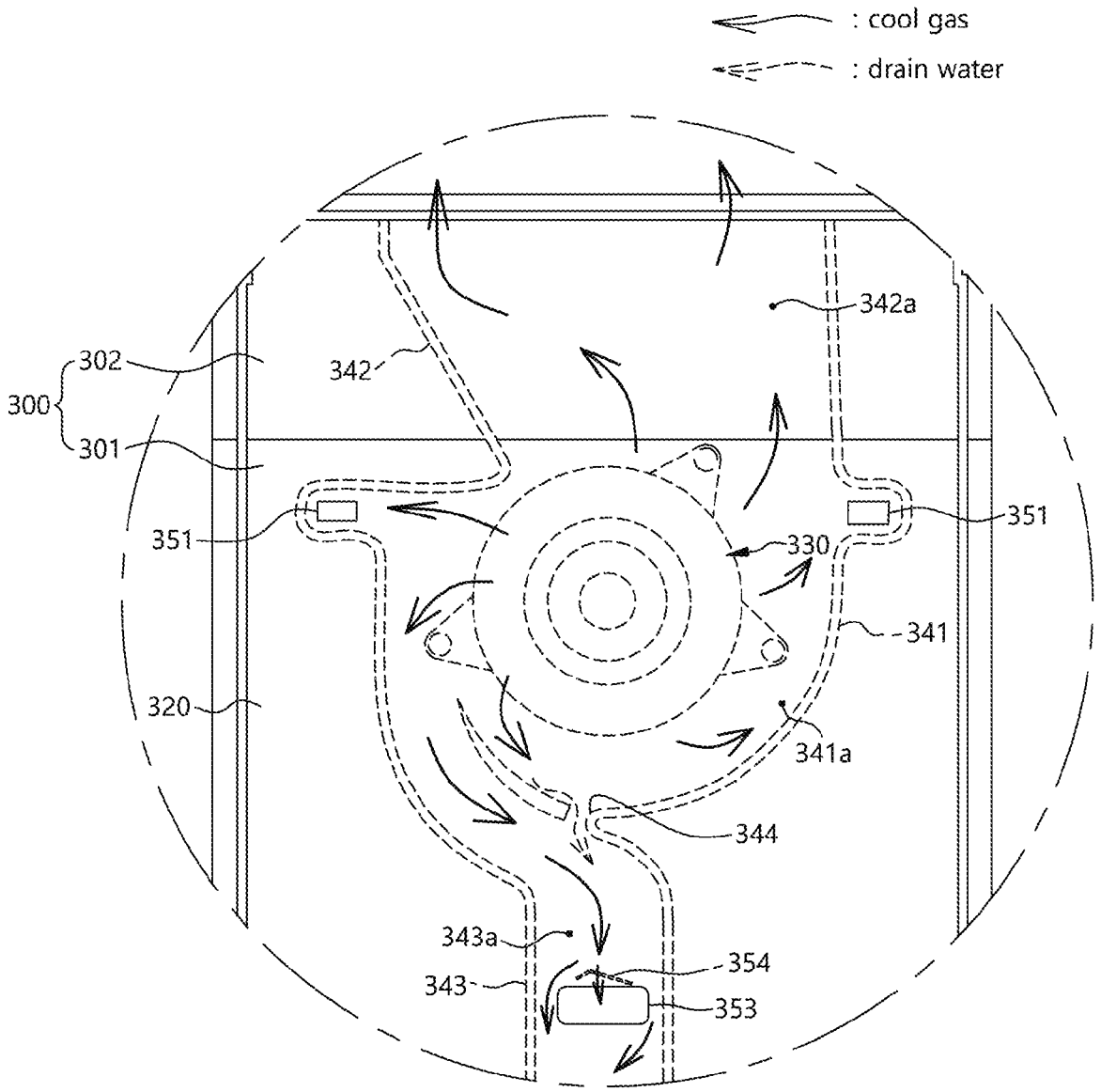
FIG. 15 is an enlarged view illustrated to describe the flow state of cold air in the surrounding area of a blower fan during the cooling operation of the refrigerator according to the embodiment of the present disclosure.

Here, FIG. 13 is a sectional view illustrated to describe the flow state of cold air during the cooling operation of the refrigerator according to the embodiment of the present disclosure; FIG. 14 is an enlarged view illustrated to describe the flow state of cold air in an important part of the first duct assembly during the cooling operation of the refrigerator according to the embodiment of the present disclosure; and FIG. 15 is an enlarged view illustrated to describe the flow state of cold air in the surrounding area of a blower fan during the cooling operation of the refrigerator according to the embodiment of the present disclosure.

The refrigeration operation may be performed by the operations of the blower fan 330 and the compressor 151.

That is, the rotation of the blower fan 330 by the supply of power to the blower fan 330 and the temperature control of the storage compartment 101 by heat exchange operation of the evaporator 200 by the operation of the compressor 151 may be performed.

In addition, when the blower fan 330 rotates, air may be blown by the rotation.

That is, the cold air of the inside of the storage compartment 101 may be introduced to the cold air introduction side of the evaporator 200 through the introduction duct 303 of the first duct assembly 300 by the blowing force of air caused by the rotation of the blower fan 330.

In this case, while the cold air passes through the introduction duct 303, the cold air may pass through the filtering member 304 installed through the introduction duct 303. In this case, various odor components and foreign matter contained in the cold air may be filtered.

In addition, while passing through the evaporator 200 located between the first part 301 of the first duct assembly 300 and the inner casing 120, cold air introduced to the cold air introduction side of the evaporator 200 may be cooled by heat exchange with refrigerant flowing inside the refrigerant tube of the evaporator 200.

Next, the cold air cooled while passing through the evaporator 200 may be introduced into the first duct assembly 300 by passing through the cold air introduction hole 311 formed in the shroud 310 of the first duct assembly 300.

Some portion of the introduced cold air may flow by circulating in the rotating direction of the blower fan 330 by the guidance of the circumferential flow path 341*a* defined by the first flow guide 341, and the remaining portion of the introduced cold air may immediately flow upward by the guidance of the upper flow path 342*a* defined by the second flow guide 342.

Accordingly, portion of the cold air flown by the guidance of the circumferential flow path 341*a* may be supplied into the storage compartment 101 through the first discharge part 351 located at the circumferential flow path 341*a*.

In this case, when it is considered that the upper perimeter of the first discharge part 351 is covered by the first flow guide 341, some of the cold air flowing along the circumferential flow path 341*a* may be efficiently discharged to the first discharge part 351 by the guidance of the first flow guide 341.

Particularly, the first discharge part 351 may be formed at each of the opposite sides of the upper side of the blower fan 330, so the cold air may be supplied to each of the opposite sides of the inside of the storage compartment 101 through the two first discharge parts 351.

Accordingly, cold air may be sufficiently supplied to the middle space (an upper space of the lower section) of the inside of the storage compartment 101 toward which the first discharge part 351 is directed.

In addition, some of cold air flown by the guidance of the circumferential flow path 341*a* may be supplied to the lower flow path 343*a* communicating with a circumferential portion of the circumferential flow path 341*a*.

Accordingly, the cold air supplied to the lower flow path 343*a* may flow downward along the lower flow path 343*a*, and then may be supplied to the lower space (to the side of the open upper surface of the storage box located at the lowest side of the storage compartment) of the lower section of the inside of the storage compartment 101 through the second discharge part 352 located at the lower end of the lower flow path 343*a*.

Particularly, when it is considered that the second discharge part 352 is formed at the center portion of the lower end of the first duct assembly 300, cold air discharged through the second discharge part 352 may be supplied to the center portion of the lower side of the inside of the storage compartment 101.

Accordingly, the direction of the cold air discharged through the second discharge part 352 and the direction of cold air introduced through the two introduction ducts 303 may not coincide with each other and may be partially misaligned with each other, so after the cold air discharged into the storage compartment 101 sufficiently cools the inside of the storage compartment 101, the cold air may be introduced to the introduction duct 303.

Meanwhile, at least some portion of cold air flowing along the lower flow path 343*a* may pass across the third discharge part 353 located in the lower flow path 343*a*. In this process, some of the cold air passing across the third discharge part 353 may be supplied to the storage compartment 101 located at the front of the third discharge part 353 through the third discharge part 353.

In this case, when it is considered that the third discharge part 353 is configured as a tube body protruding to the front of the grille plate 320, the cold air discharged through the third discharge part 353 may be sufficiently supplied to the front side of the inside of the storage compartment 101.

Particularly, in the rear surface of the grille plate 320, the limiting protrusion 354 may be famed at a portion located directly above the third discharge part 353 by protruding therefrom. Accordingly, only some portion of the cold air flowing along the lower flow path 343*a* may be supplied into the storage compartment 101 through the third discharge part 353.

In this case, the flow amount of the cold air supplied to the storage compartment 101 may be controlled according to the size or thickness of the limiting protrusion 354.

Furthermore, the remaining portion of cold air introduced into the first duct assembly 300 by passing through the cold air introduction hole 311 of the first duct assembly 300 may be discharged to the upper flow path 342*a*, and then pass through the inclined second part 302 of the first duct assembly 300 by the guidance of the upper flow path 342*a*, and then may be supplied to the cold air flow path 421 of the second duct assembly 400 connected to the inclined second part 302.

Of course, cold air which is not discharged to the first discharge part 351 or the lower flow path 343*a* while the cold air introduced to the first duct assembly 300 by passing through the cold air introduction hole 311 flows along the circumferential flow path 341*a* may be supplied to the cold air flow path 421 through the upper flow path 342*a* with cold air discharged directly from the blower fan 330 toward the upper flow path 342*a*.

In addition, the cold air supplied to the cold air flow path 421 of the second duct assembly 400 may flow upward along the cold air flow path 421, and during the upward flow of the cold air, may pass through communication holes 422 formed at the heights of the cold air flow path 421 and the cold air discharge parts 411 corresponding to the communication holes 422, and may be supplied to each space of the storage compartment 101.

In addition, the remaining portion of the cold air flowing upward along the cold air flow path 421 may be supplied to the upper space of the inside of the storage compartment through the upper discharge part 412 formed at the upper end of the cold air flow path 421.

Particularly, the cold air discharged to the upper discharge part 412 may be efficiently discharged toward the inside of the storage compartment 101 located at the front of the upper discharge part 412 by the guidance of the round upper surface of the upper discharge part 412.

In addition, the cold air supplied into the storage compartment 101 through each of the discharge parts 351, 352, and 353 of the first duct assembly 300 and each of the cold air discharge parts 411 and 412 of the second duct assembly 400 may cool goods stored inside the storage compartment 101, and may pass through the introduction duct 303 of the first duct assembly 300 due to blowing force caused by the rotation of the blower fan 330, and may be introduced to the cold air introduction side of the evaporator 200. Accordingly, this circulation of the cold air may repeat.

Meanwhile, while cold air introduced into the circumferential flow path 341*a* through the cold air introduction hole 311 flows along the circumferential flow path 341*a*, portion of the cold air may be discharged through the drain hole 344 formed in the first flow guide 341.

However, in consideration of the fact that the drain hole 344 is configured to communicate with the inside of the lower flow path 343*a*, the portion of the cold air may be supplied only into the lower flow path 343*a* despite the discharge of the portion of the cold air to the drain hole 344, but may not be discharged to the outside, so the loss of the flow amount of the cold air may be prevented.

In addition, during the cooling operation of the storage compartment 101, while cold air having high humidity in the storage compartment 101 is heat-exchanged while passing through the evaporator 200, moisture contained in the cold air may be condensed on the evaporator 200.

While the condensed water flows on the evaporator 200, the condensed water may be stored in the condensate water reservoir 121 located under the evaporator 200, and then may be drained to the outside.

In this case, with portion of the water condensed on the surface of the evaporator 200 contained in cold air passing through the evaporator 200 due to the cold air introduction force of the blower fan 330, the portion of the condensed water may pass through the cold air introduction hole 311 and may be introduced into the first duct assembly 300.

However, the introduced water as described above may be drained to the lower flow path 343*a* through the drain hole 344 formed in the first flow guide 341.

In addition, the water drained to the lower flow path 343*a* may flow down along the lower flow path 343*a*, and then may be discharged to the condensate water reservoir 121 located under the evaporator 200 through the water discharge hole 345 famed in the bent portion of the lower end of the lower flow path 343*a*.

Accordingly, the water flowing down into the lower flow path 343*a* may not be discharged into the storage compartment 101, but may be efficiently discharged to a side at which the condensate water reservoir 121 is located.

Finally, due to the repetition of the cold air circulation described above, the inside of the storage compartment 101 may be maintained at constant temperature.

As described above, in the refrigerator of the present disclosure, due to the provision of the first discharge part 351, cold air may be supplied even into the storage compartment 101 located at the front side of a portion at which the blower fan 330 is located, so temperature distribution difference between upper and lower sections inside the storage compartment 101 may be reduced as much as possible.

In addition, in the refrigerator of the present disclosure, due to the provision of the third discharge part 353, cold air may be sufficiently supplied even to the center portion of the lower section of the storage compartment (a lower storage compartment relative to the position of the blower fan), so temperature distribution may be improved in the space of the lower section inside the storage compartment 101.

Furthermore, in the refrigerator of the present disclosure, the lower flow path 343*a* may be configured along the center portion of the first duct assembly 300, so a recessed part may be provided at each of the opposite sides of the lower flow path 343*a* and lower storage space may be increased as largely as the size of such a recessed part 321.

Additionally, in the refrigerator of the present disclosure, the drain hole 344 configured to drain water produced at the surrounding area of the blower fan 330 may be configured to communicate with the inside of the lower flow path 343*a*, and thus despite the discharge of the cold air to the drain hole 344, the cold air may be discharged into the lower flow path 343*a*, so the loss of the flow amount of the cold air may be prevented.

In addition, in the refrigerator of the present disclosure, the condensate water drained into the lower flow path 343*a* may be immediately discharged to a portion located under the evaporator 200 without passing through the evaporator 200, and may be stored in the condensate water reservoir 121, so the condensate water discharged from the first duct assembly 300 may be prevented from being condensed on the evaporator 200.

Additionally, in the refrigerator of the present disclosure, the second part 302 of the first duct assembly 300 connected to the second duct assembly 400 may be configured to gently incline from the blower fan 330, and thus cold air may efficiently flow without the rapid change of the flow direction of the cold air.

Accordingly, the flow resistance of cold air may be reduced, so noise caused by the flow resistance may be prevented and consumption efficiency may be improved.

In addition, in the refrigerator of the present disclosure, the filtering member 304 may be provided in the introduction duct 303, so foreign matter contained in cold air flowing toward the evaporator 200 may be filtered.

What is claimed is:

1. A refrigerator comprising:

a cabinet that defines a storage compartment;

an evaporator located inside the cabinet;

a first duct assembly located at a front of the evaporator, the first duct assembly comprising a blower fan configured to generate a flow of cold air passing through the evaporator; and a second duct assembly coupled to an upper side of the first duct assembly and configured to guide the cold air received from the first duct assembly to the storage compartment, wherein the first duct assembly comprises a plurality of flow guides that are disposed inside the first duct assembly, the plurality of flow guides defining:

a circumferential flow path that accommodates at least a portion of the blower fan and is configured to guide the cold air in a circumferential direction of the blower fan, an upper flow path configured to guide the cold air from the circumferential flow path to the second duct assembly, a lower flow path configured to guide the cold air supplied from the circumferential flow path to a lower end of the first duct assembly, a first discharge part defined within the circumferential flow path and configured to discharge the cold air into the storage compartment, a second discharge part defined at a lower end of the lower flow path and configured to discharge the cold air guided along the lower flow path into the storage compartment, a third discharge part defined within the lower flow path, the third discharge part being defined between the first discharge part and the second discharge part and configured to discharge a portion of the cold air guided along the lower flow path into the storage compartment, and a drain hole defined at a lower portion of the circumferential flow path, the drain hole being defined between a lower circumference of the blower fan and the third discharge part to thereby to provide water from the circumferential flow path to the lower flow path, wherein a width of the lower flow path is greater than a width of the drain hole, wherein the width of the drain hole is less than a width of the third discharge part, wherein the plurality of flow guides comprise:

a first flow guide that surrounds the lower circumference of the blower fan and defines the circumferential flow path, a second flow guide that extends to an upper side of the first flow guide and defines the upper flow path, and a third flow guide that extends from a lower end of the first flow guide and defines the lower flow path, wherein a lower portion of the first flow guide extends inward toward a vertical reference line passing through a center of the blower fan along the circumferential direction of the blower fan, the lower portion of the first flow guide defining the lower end of the first flow guide that is connected to an upper end of the third flow guide, and wherein an upper portion of the third flow guide extends downward from the upper end of the third flow guide and is curved outward away from the vertical reference line of the blower fan to thereby define the drain hole between the first flow guide and the third flow guide.

2. The refrigerator of claim 1, wherein the first discharge part is located vertically higher than the center of the blower fan.

3. The refrigerator of claim 1, wherein the first discharge part comprises a plurality of first discharge parts defined at opposite sides with respect to the blower fan.

4. The refrigerator of claim 1, wherein the first duct assembly comprises:

a first part located at the front of the evaporator, the blower fan being coupled to a rear surface of the first part; and a second part that extends upward from an upper end of the first part and is inclined rearward with respect to an upward direction, the second part being connected to a lower end of the second duct assembly.

5. The refrigerator of claim 4, wherein the blower fan is located vertically higher than the evaporator, and wherein the first discharge part is defined in the first part of the first duct assembly and comprises a plurality of first discharge parts defined at opposite sides with respect to the blower fan.

6. The refrigerator of claim 1, wherein the first duct assembly further comprises:

a shroud that faces the evaporator and defines a cold air introduction hole; and a grille plate coupled to a front side of the shroud, and wherein the blower fan is located between the grille plate and the shroud.

7. The refrigerator of claim 6, wherein the first discharge part is defined at the grille plate.

8. The refrigerator of claim 6, wherein the grille plate defines a recess that is recessed from a front surface of the grille plate toward the shroud, the front surface facing the storage compartment.

9. The refrigerator of claim 8, wherein the recess is defined at at least one side of the lower flow path.

10. The refrigerator of claim 1, wherein the first discharge part protrudes from the first duct assembly.

11. The refrigerator of claim 1, wherein the second discharge part is configured to discharge the cold air guided along the lower flow path into the storage compartment.

12. The refrigerator of claim 11, wherein the first duct assembly further comprises an introduction duct located at at least one side of the second discharge part and configured to guide the cold air from the storage compartment toward the evaporator.

13. The refrigerator of claim 12, wherein the first duct assembly further comprises a filtering member located in the introduction duct.

14. The refrigerator of claim 1, wherein the lower flow path extends from a circumference of the circumferential flow path and is configured to supply the cold air from the circumferential flow path to the lower end of the first duct assembly.

15. The refrigerator of claim 1, wherein a curvature of the lower end of the first flow guide is greater than a curvature of an upper portion of the first flow guide that is disposed above the lower end of the first flow guide and defines the circumferential flow path.

16. The refrigerator of claim 1, wherein the vertical reference line passes through the third discharge part and the second discharge part, and wherein the discharge part is defined at a side of the vertical reference line.

17. The refrigerator of claim 1, wherein the first flow guide protrudes outward away from the vertical reference line of the blower fan and is curved around the first discharge part.

18. The refrigerator of claim 1, wherein the first duct assembly further comprises a limiting protrusion disposed within the lower flow path and configured to limit an amount of the cold air flowing toward the third discharge part.

19. The refrigerator of claim 18, wherein the limiting protrusion is located below the drain hole and above the third discharge part.

* * * * *